US006270896B1

(12) United States Patent
Bastiaansen et al.

(10) Patent No.: US 6,270,896 B1
(45) Date of Patent: Aug. 7, 2001

(54) ELASTIC FIBER

(75) Inventors: Cornelis W. M. Bastiaansen, Maastricht; Franciscus W. M. Gelissen, Selfkant; Edwin Willems, Sittard; Cornelis Versluis, Stein, all of (NL)

(73) Assignee: DSM N.V., Heerlen (NL)

( * ) Notice: Subject to any disclaimer, the term of this patent is extended or adjusted under 35 U.S.C. 154(b) by 0 days.

(21) Appl. No.: 09/201,907

(22) Filed: Nov. 30, 1998

Related U.S. Application Data

(63) Continuation of application No. PCT/NL97/00302, filed on May 29, 1997.

(30) Foreign Application Priority Data

May 31, 1996 (NL) ..... 1003240

(51) Int. Cl.[7] ..... D02G 3/00

(52) U.S. Cl. ..... 428/373; 428/401; 428/483; 428/492

(58) Field of Search ..... 428/220, 332, 428/339, 373, 401, 395, 480, 483, 492

(56) References Cited

U.S. PATENT DOCUMENTS

| | | | | |
|---|---|---|---|---|
| 4,141,863 | | 2/1979 | Coran et al. . | |
| 4,290,927 | * | 9/1981 | Tanaka et al. | 260/3 |
| 4,367,316 | | 1/1983 | Tanaka et al. . | |
| 4,629,761 | | 12/1986 | Wolfe, Jr. . | |
| 4,843,124 | | 6/1989 | Wolfe, Jr. . | |
| 5,502,095 | | 3/1996 | Ueshima et al. . | |
| 5,550,190 | | 8/1996 | Hasegawa et al. . | |

FOREIGN PATENT DOCUMENTS

| | | |
|---|---|---|
| 0 293 821 | 12/1988 | (EP) . |
| 0 506 465 | 9/1992 | (EP) . |
| 0 596 734 | 5/1994 | (EP) . |

* cited by examiner

*Primary Examiner*—Bruce H. Hess
*Assistant Examiner*—B. Shewareged
(74) *Attorney, Agent, or Firm*—Pillsbury Winthrop LLP

(57) ABSTRACT

An elastic fiber of a mixture containing a copolyether ester or a copolyester ester and a chemically crosslinked rubber, which fiber has a permanent elongation after 100% stretching of at most 9% and an elongation at break of at least 450% and a process for producing an elastic fiber comprising the melt spinning of a mixture of a copolyether ester or a copolyester ester and a rubber to form a fiber, in which the rubber is completely or almost completely crosslinked at the moment the fiber is formed, and are disclosed.

17 Claims, No Drawings

ELASTIC FIBER

This is a Continuation of: International Application No. PCT/NL97/00302 filed May 29, 1997 which designated the U.S.

The invention relates to an elastic fibre containing a copolyester ether or a copolyester ester.

Copolyether esters and copolyester esters will hereinafter jointly be referred to as copolyester.

Such a copolyester fibre is known from the report of a paper, 'Neues aus Forschung und Entwicklung', read by Vieth during the 34th Internationale Chemiefasertagung Dornbirn, 20–22 Sep. 1995.

A drawback of this known fibre is its low elastic recovery manifesting itself in a high permanent elongation which occurs after stretching of the fibre. The aforementioned publication shows that, after the fibre has been stretched by 100% of its original length, its recovery from this stretch is not more than 90%. Thus the length of the fibre has increased permanently by at least 10% of its original length. This substantially limits the application of the known fibre as a component imparting elastic properties to a yarn or fabric. This limitation is conceded also in said publication. The same publication shows that, while the permanent elongation is indeed reduced by after-stretching, the elongation at break shows a substantial deterioration.

What has now been found is an elastic fibre containing a mixture of a copolyester ether or a copolyester ester and a chemically crosslinked rubber.

Surprisingly, such a fibre has a permanent elongation of at most 9% after the fibre has been stretched 100% and an elongation at break of at least 450%. Indeed, fibres have been found showing a permanent elongation of at most 6% after stretching the fibre 100% and an elongation at break of at least 500% and even 600%.

It has been found that by after-stretching the fibres according to the invention fibres are obtained having an even substantially lower permanent elongation after stretching the fibre 100%. The invention therefore also relates to fibres of the composition described having a permanent elongation of at most 5% after stretching the fibre 100% and even at most 3% and even at most 2%.

Thus the fibre according to the invention has been found to possess a particularly high degree of elastic recovery in combination with a high elongation at break.

Many applications of elastic fibres involve elongations substantially higher than 100% of the original length. Even at these higher elongations the fibre according to the invention has been found to exhibit an excellent elastic recovery. Even on being stretched by 200% of its original length, the fibre according to the invention exhibits a permanent elongation of at most 15% and in many cases of at most 10% and even 5% or 2% of the length of the fibre before stretching.

The permanent elongation after stretching, henceforth referred to as 'tension set', is measured at room temperature by gripping a fibre of a given length in the jaws of a tensile testing machine and moving the jaws apart at a speed of 200 mm/min until the desired stretch is reached. To this end, markings are provided on the fibre at a distance of 50 mm, $l_0$. The fibre is kept in its stretched state for 10 seconds, whereupon the tensile force acting on the fibre is removed and the fibre is taken from the jaws. After allowing the fibre to relax at room temperature for 1 hour, the tension set in % is determined by dividing the difference in distance between the markings, 1, on the fibre that has been allowed to relax after stretching and the original distance, $l_0$, between these markings by that original distance $l_0$ and multiplying the quotient by 100.

Copolyether esters and copolyester esters are segmented block copolymers built up from hard, crystalline and relatively high-melting polyester segments and soft, flexible and relatively low-melting polyether or polyester segments. Suitable hard polyester segments for the fibres according to the invention are, for instance, polyalkylene terephthalates, for instance poly(butylene-naphthalene dicarboxylic acid), poly(cyclohexanedicarboxylic acid-cyclohexanemethanol) and preferably polybutyleneterephthalate and polytrimethyleneterephthalate-2,6-naphthalate. Other types of hard polyester segments conforming to the requirements set can be used in a block copolymer as well and also a plurality of types can be used simultaneously. Polyester units suited for the hard crystalline segment are built up, for instance, from an acid and a glycol. Suitable acids are, for instance, terephthalic acid and 2,6-naphthalenedicarboxylic acid. In addition to the terephthalic acid and/or 2,6-naphthalenedicarboxylic acid a small amount of a different dicarboxylic acid can be added, for instance isophthalic acid, or an aliphatic dicarboxylic acid, for instance adipic acid, cyclohexane-1,4-dicarboxylic acid or a dimeric acid. The chosen glycol component of the polyester unit may be a glycol having, for instance, two to twelve carbon atoms, for instance ethylene glycol, propylene glycol, tetramethylene glycol, neopentyl glycol, hexane diol or decane diol.

Suitable soft polyester segments are, for instance, aliphatic polyesters, including polybutylene adipate and preferably polytetramethyladipate and polycaprolactone. Other types of soft polyester segments conforming to the requirements set can be used in a block copolymer as well and also a plurality of types can be used simultaneously. Suitable polyether segments are, for instance, polyalkylene oxides, including polytetramethylene oxide, polypropylene oxide, polyethylene oxide. Other types of polyether segments conforming to the requirements set can be used in a block copolymer as-well and also a plurality of types can be used in a copolyester simultaneously. Highly suited are copolyether esters in which the polyester segments are polyalkyleneterephthalates, preferably polybutyleneterephthalate, and the polyether segments are polyalkyleneoxides, preferably polytetramethyleneoxide.

Suitable copolyether esters in the fibre according to the invention in any case have a processing temperature, particularly a melting temperature, below the temperature at which an appreciable thermal degradation takes place in the polymer.

There are no special limitations regarding the upper limit of the melting point of the low-melting portion of the copolyester. It is usually 130° C. or lower, preferably 100° C. or lower. The weight-average molecular weight of the low-melting polymer segment is between 200 and 10000 g/mol, preferably between 400 and 6000 g/mol.

The % (wt) ratio between the high-melting crystalline segment and the low-melting flexible segment of the copolyester is between 95:5 and 5:95 and preferably between 70:30 and 30:70.

By a chemically crosslinked rubber is meant a rubber which through chemical reactions has been formed into an insoluble and unmeltable polymer, the molecule chains in which are interlinked to form a three-dimensional network structure. Examples of the said reactions are described in the Encyclopedia of Polymer Science and Engineering, Second Edition, John Wiley and Sons, Volume 4, page 350 et seq. and page 666 et seq.

Suitable rubbers for the fibre of the invention are acrylic rubbers, butyl rubbers, halogenated rubbers, for example brominated and chlorinated isobutylene-isoprene, (styrene-)

butadiene rubbers, butadiene-styrene-vinylpyridine, nitrile rubbers, natural rubber, urethane rubbers, silicone rubbers, polysulphide rubbers, fluorocarbon rubbers, ethylene-propylene-(diene-)rubbers (generally referred to as EP(D)M rubbers), polyisoprene, epichlorohydrine, chlorinated polyethylene, chloroprene, chlorosulphonated polyethylene. Preferably, the fibre contains the economically attractive and commonly used acrylic rubbers, (styrene-)butadiene rubbers, butyl rubbers, chlorinated polyethylene, chloroprene, chlorosulphonated polyethylene, epichlorohydrine, ethylene-propylene-(diene-)rubbers, nitrile rubbers, natural rubber, polyisoprene or silicone rubbers. EP(D)M rubbers are highly suitable. The fibre may also contain mixtures of different rubbers, at least one of which is chemically crosslinked.

The rubber in the fibres may be crosslinked by any known technique, the most suitable technique being chosen for each rubber. Crosslinking is usually effected under the influence of crosslinking agents, familiar examples of which are sulphur, peroxides, metal oxides, (organo)silane compounds, epoxy resins, quinone dioximes, phenol resins, alkylphenol formaldehyde resins, diurethanes, bismaleimides and amines. Halogenated butyl rubber, for example, can be crosslinked with zinc oxide but also by using resins, for example (brominated) phenol resin and urethane resin. These resins are also suitable crosslinking agents for, for instance, EPDM rubber. Organic peroxides and sulphur, too, are known and suitable as crosslinking agents. Crosslinking may optionally be effected in the presence of accelerators and/or activators. It is preferred for the mixture to be a thermoplastic vulcanizate. A thermoplastic vulcanizate, known per se and usually abbreviated to TPV, is obtained by static or dynamic vulcanization or crosslinking of the rubber in the presence of the copolyester. Dynamic vulcanization means a process by which in a composition containing a non-crosslinked rubber and a thermoplastic polymer, in the present case a thermoplastic elastomer, the rubber is crosslinked under high shear. The mixture has preferably been subjected to dynamic vulcanization because in such a mixture the distribution of the rubber in the copolyester is very homogeneous and the fibres have the best properties. Dynamic vulcanization can take place in the known mixing devices, for instance roll mills, Banbury mixers, continuous mixers, kneaders and mixing extruders, of which twin-screw extruders are preferred.

A summary of the known dynamic vulcanization techniques is given in Paper No. 41 of the Meeting of the Rubber Division of the American Chemical Society, Nov. 4, 1992, in Nashville, Tenn., USA.

The choice of crosslinking agent is determined in the first instance by its suitability to crosslink the rubber. In addition, the crosslinking agent should be so chosen that the crosslinking agent has no undesirable effect on the copolyester. Undesirable effects known in the art are, for instance, degradation, discoloration, or crosslinking of the copolyester. In any case in which this is not already known in the relevant field of operation the person skilled in the art can establish through simple experiment whether the envisaged crosslinking agent and the envisaged copolyester are compatible with each other.

The rubber may contain the usual additives. Examples hereof are hardening agents, accelerators, retarders, activators, fillers, extenders, plasticizers, other polymers, colour modifiers, antidegradants such as antioxidants, antiozonants, compatibilizers, thermal stabilizers and UV stabilizers.

In choosing and determining the number of rubber parts by weight in the fibre it is the rubber exclusive of the additives with crosslinking agent contained therein that is started from.

The fibre may further contain or be covered with substances that can have an effect on the appearance, the processability and the properties in use. Examples hereof are matting agents, brightening agents, surfactants, dyes, pigments and light, UV and heat stabilizers.

The fibres according to the invention, or the individual filaments making the fibre a multifilament fibre, have a titre of 5–1000 dtex, preferably between 10 and 500 dtex and more preferably between 20 and 250 dtex. The elongation at break practically equals that of the rubber and is at least 100% and may be at least 400% or even at least 500%, depending on the tension set as indicated earlier herein.

The fibres are particularly suitable for imparting elastic properties to textile materials, fabrics and knittings. Examples hereof are bathing wear, underwear, sportswear, leisure wear, stockings, tights, socks, elastic bands in clothes, diapers and medical bandages.

The fibres according to the invention may be applied as they are, but it is also possible for other fibres, particularly polyester, polyamide or cotton, to envelop them or to be wound or spun round them, or the fibres may be processed together with other fibres by the techniques known in the art to form elastic yarns.

'Fibre' as used earlier and later herein should be taken to include a tape or film and in general any object measuring at most 1000 $\mu$m, preferably at most 500 $\mu$m, more preferably at most 250 $\mu$m, and most preferably at most 100 or even 50 $\mu$m, in at least one direction. The cross-section of the fibre or of a filament, if the fibre is a multifilament, may be round, oval or multi-lobed, for instance tri-lobed. Examples of such shapes are to be found in Introductory Textile Science, Fifth Edition, by Marjory L. Joseph, published by Kolt, Rinehart and Winston Inc., page 40.

The invention also relates to a process for the manufacture of an elastic fibre as defined above, comprising the melt spinning of a mixture of a copolyester and a rubber, in which process the rubber is completely or almost complete crosslinked at the moment the fibre is formed.

It has surprisingly been found that the process according to the invention is capable of producing elastic fibres exhibiting a very good elastic recovery in combination with a high elongation at break. It has proved to be possible thus to produce fibres with a tension set of at most 10% and even at most 5% after stretching by 100% of the original length and an elongation at break of at least 500% and even of at least 600%. It has further been found that by stretching the fibre obtained by the process according to the invention fibres are obtained having a tension set of at most 5%, 3% or even 2% after stretching by 100% of the original length.

A further advantage of the process is that a high rate of production can be achieved thanks to the high spinning speeds that have proved to be possible. Further, in the usual processes for processing rubber-containing materials the crosslinking of the rubber is not effected until the rubber-containing material has been given its desired shape. This involves an extra and frequently time-consuming process step. In the process according to the invention a previously crosslinked rubber is started from, thus obviating the need for the time-consuming crosslinking of the spun fibre.

The good spinnability at a high spinning speed of a mixture containing a completely or almost completely crosslinked rubber is surprising in itself, because the dynamic viscosity of such mixtures at the required spinning temperature, which is 150–350° C. depending on the copolyester applied, is between 1,000,000 and 1000 Pa.s at shear rates of 0.1 and 200/s respectively. According to the textbook Plastic Extrusion Technology, ed. Friedhelm Hensen, Hansen Publishers, Munich, page 566, usual values for the viscosity of a spinnable mixture are in the range of 80 to 300 Pa.s if an acceptable spinning speed is to be achieved. Considering the high viscosity, a person skilled in the art would expect the highest attainable spinning speed to be 10 m/min. However, much higher spinning speeds ranging from 100 and 500 to 1000 m/min and even 1200 m/min and higher have been found to be possible in the process according to the invention. Constraints, if any, have been found to be imposed only by the limited capabilities of the spinning equipment, not by the spinning behaviour of the mixture.

Another advantage of the process according to the invention is the possibility of producing thin fibres in a simple manner. Thus fibres with a titre of 10 and even 5 dtex can be produced. Generally, and also in the process according to the invention, the production of thicker fibres entails fewer problems than the spinning of thin fibres. Thicker fibres of up to, for instance, 25, 50, 100 or even 250 dtex can easily be produced by using larger spinneret holes. Still thicker fibres, of up to 500, 1000 or more dtex, are possible, too, but at such thicknesses one should rather speak of threads or tapes. Even at such thicknesses the good spinnability of the starting mixtures affords the aforementioned process advantages whilst even then the favourable material properties are present in the products produced. The thickness of the fibre can be reduced by stretching the fibre during or after the spinning. The stretching can be effected in a wide temperature range, for instance from 0° C. to nearly the melting temperature of the copolyester, but preferably not at a temperature higher than the melting temperature of the copolyester minus 3° C. The melting point of the copolyester is determined mainly by the hard segment and can be found using standard techniques like DSC. After stretching, the fibre is preferably allowed to relax by exposing it to a certain temperature for some length of time preferably without tension. The fibre will then shrink, so that the elongation caused by the stretching is partly eliminated again. The relaxation is deemed to be complete when no appreciable further reduction of length is observed. The relaxation temperature, too, is preferably between 0° C. and the melting temperature of the copolyester and can be so chosen as to equal or to differ from the stretching temperature. The time chosen to allow the fibre to relax may be shorter as the relaxation temperature is higher.

In the process according to the invention a mixture of a copolyester and a rubber is spun, the rubber being completely or almost completely crosslinked at the moment when the fibre is formed. The mixture contains 10–90 parts by weight rubber against 90–10 parts by weight of the copolyester and preferably 30–75 parts by weight rubber against 70–25 parts by weight copolyester. Most preferably, the mixture contains 55–70 parts by weight rubber against 45–30 parts by weight copolyester. In determining the rubber content, the rubber is considered exclusive of any additives contained therein, including the crosslinking system.

Suitable and preferred rubbers and copolyesters are those described in the foregoing as being suitable and preferred for the elastic fibre according to the invention. The usual and known additives mentioned there may also be added to the mixture to be spun.

The process can be carried out using any mixture that has the required characteristics. From a process engineering point of view it is advantageous for the mixture to be prepared and spun in a single continuous process operation. It is preferred for the mixture of the crosslinked rubber and the copolyester to be prepared from a mixture of non-crosslinked rubber and the copolyester in the presence of a crosslinking agent. It is acceptable for the rubber to be crosslinked already to a slight degree before it is mixed with the copolyester. It is essential, however, that at that point the rubber should be non-crosslinked to the extent that it still behaves as a thermoplastic and should be miscible with the copolyester in the melt.

Suitable methods of preparing the mixture have been described in the foregoing. Preferably, the mixture is a TPV produced by dynamic vulcanization as described in the foregoing. In general, the mixing and kneading applied herein is continued until the rubber is completely or almost completely crosslinked. By this is meant that the rubber is crosslinked far enough for it to have such elastomeric properties as are commonly associated with a rubber that has been vulcanized in the usual manner, that is, as such and not dynamically in the presence of a copolyester. The extent to which the crosslinking has progressed can be characterized by the rubber fraction that can be extracted at elevated temperature from the dynamically vulcanized mixture using a solvent for the rubber. Preferably, this fraction is at most 40% (wt), more preferably at most 25% (wt) or even at most 10% (wt) and most preferably at most 5% (wt) referred to the amount of rubber in the mixture. The tension set decreases as the extractable fraction decreases. The determination of the extractable rubber fraction is a technique known per se in the art. The solvent used is a solvent which is known to be good for the rubber in question. In general, for instance, boiling xylene is used for determining the extractable fraction in EP(D)M.

Part of the crosslinking operation may also take place during the spinning step. In this spinning step the mixture is remelted, homogenized and conveyed to the spinning head, where the actual formation of the fibre takes place. As a rule, the said operations take place at an elevated temperature and under the exertion of shear stresses and so under conditions conducive to dynamic vulcanization.

The wholly or, as described above, possibly only partially crosslinked mixture may be fed to a spinning apparatus. The mixing system may then be integrated with the spinning apparatus, which in that case is composed of, for instance, an extruder in which the rubber and the copolyester are mixed with simultaneous crosslinking of the rubber. The mixture may be heated in that process to a temperature higher than the melting point of the copolyester, where it becomes melt-processable. The mixture may then be supplied in that form to a spinneret which closes the extruder, the spinneret having spinning holes of the desired shape and size and in the desired quantity. The molten mixture may also be supplied to a spinning pump and from there to a spinneret. In that case, the actual formation of the fibres takes place in the spinneret. In that location the mixture is present in a melt-processable form and the rubber is completely or almost completely crosslinked.

If so desired, the preparation of the mixture and the spinning may take place at separate times and places. The mixture, which may or may not be completely crosslinked, may, optionally after cooling, be reduced in size and the granulate obtained or the original lumps may be supplied later and/or elsewhere to a spinning apparatus, where the rubber is crosslinked further if necessary and the mixture, together with the crosslinked rubber, is remelted and supplied to the spinneret as a melt.

The spinning apparatus used may be any known apparatus that is optionally capable of preparing the mixture with or without simultaneous crosslinking of the rubber, but which is in any case capable of melting the mixture and forcing the molten mixture at the desired speed through a spinneret having holes of the desired shape and size. If necessary, it should also be possible for the conditions required for complete or partial crosslinking of the rubber to be established in the spinning apparatus.

The fibre is spun in the air or in a space in which an inert gas or liquid is present. Depending on the mixture used, the gas, air or liquid may be kept at ambient temperature or at an elevated temperature, the latter preferably below the melting point of the copolyester. The fibre may be exposed also to a steam atmosphere immediately after it has left the spinning head. In many cases, after it has followed a certain path through air, gas or steam, the spun fibre is passed through a liquid bath, particularly a water bath, for further and, if so desired, more rapid cooling. The fibre will thus cool and acquire a stable form and may be wound onto a bobbin. The fibre can be spun and wound onto a bobbin as a monofilament but also as a multifilament. The fibre may be subjected to a draw-down operation during or immediately after spinning, when the fibre is still in wholly or partially molten condition. In this way, fibres with a lower titre can be obtained. As explained earlier herein, to lower the titre the fibre may also be stretched immediately afterwards or in a separate step, which will also serve to improve the tension set.

The fibre may further be subjected to other after-treatments that are usual for fibres, such as a heat treatment, shrinking, crimping and dyeing. Also, other fibres or yarns of, for example, polyamide, cotton and polyester may be spun round the fibre, or the fibre may be co-spun with other fibres or yarns or be knit or woven.

The invention will be elucidated by the following examples without, however, being limited thereto.

The fibres were spun with a Fourne Spintester with a spinning pump of 1.2 cc or with a Gottfert Viscotester 1500 with a spinneret having a length L of 20 mm, a diameter D of 0.5 mm (L/D =40), a barrel diameter of 12 mm and a plunger speed of 0.2 mm/s (unless expressly stated otherwise).

The mechanical properties of the fibres were examined using a Zwick 1435 tensile testing machine at a testing speed of 20 cm/min and with the grips 5 cm apart.

Example I

The following materials were successively supplied to a Haake 50 cc Banbury kneader:

at t=0 23.8 g EPDM (Keltan® 778);

at t=1 min. 17.5 g copolyether ester (Arnitel® EM400), 2.82 g pigment (Kronos® 2210), 0.18 g Irganox® 1098 as stabilizer; and at t=4 min. 2.7 g phenol resin (Schenectedy® SP1045).

On commencement of the experiment the temperature and the speed of the kneader were set at respectively 225° C. and 100 RPM. After 8 minutes the mixture obtained (TPV) was discharged and cooled to room temperature.

A part of the mixture was used to produce a monofilament elastic fibre by melt spinning. In the process a Göttfert Viscotester was used.

The spun fibre had the following properties:

| | |
|---|---|
| Titre | 1430 dtex |
| Tensile strength | 1.7 cN/tex |
| Elongation at break | 920% |
| Tension set after 50% elongation | 2% |
| Tension set after 100% elongation | 6% |
| Tension set after 200% elongation | 16% |
| Tension set after 300% elongation | 30% |

A similar fibre was drawn at 20° C. to 9×(800%) its original length. The properties of the fibre were measured again after allowing the fibre to relax for 24 hours (20±2° C., 65±5% relative humidity). The stretched fibre had the following properties:

| | |
|---|---|
| Titre | 660 dtex |
| Tensile strength | 3.1 cN/tex |
| Elongation at break | 410% |
| Tension set after 50% elongation | 0% |
| Tension set after 100% elongation | 1% |
| Tension set after 200% elongation | 4% |
| Tension set after 300% elongation | 8% |

EXAMPLE II

The mixture from Example I was used to produce a multifilament elastic fibre. The Gottfert Viscotester used on that occasion was equipped with a multifilament spinneret (4×100 $\mu$m, L/D=2).

The spun fibre had the following properties:

| | |
|---|---|
| Titre | 388 dtex (97 dtex per filament) |
| Tensile strength | 1.6 c/tex |
| Elongation at break | 620% |
| Tension set after 50% elongation | 2% |
| Tension set after 100% elongation | 7% |
| Tension set after 200% elongation | 17% |
| Tension set after 300% elongation | 32% |

A similar fibre was drawn at 20° C. to 5×(400%) its original length. The properties of the fibre were measured again after allowing the fibre to relax for 24 hours (20±2° C., 65±5% relative humidity). The stretched fibre had the following properties:

| | |
|---|---|
| Titre | 280 dtex (70 dtex per filament) |
| Tensile strength | 2.9 cN/tex |
| Elongation at break | 360% |
| Tension set after 50% elongation | 0% |
| Tension set after 100% elongation | 1% |
| Tension set after 200% elongation | 5% |
| Tension set after 300% elongation | 9% |

EXAMPLE III

The following materials were successively supplied to a Haake 50 cc Banbury kneader:

at t=0 24.0 g NBR rubber (Nysyn® 405);

at t=1 min. 18.8 g copolyether ester (Arnitel® EM400), 0.19 g Irganox® 1098 as stabilizer; and at t=4 min. 4.23 g phenol resin (Schenectedy® SP1045).

On commencement of the experiment the temperature and the speed of the kneader were set at respectively 225° C. and 100 RPM. After 8 minutes the dynamically vulcanized mixture (TPV) was discharged and cooled to room temperature. A part of the mixture was used to produce a monofilament elastic fibre by melt spinning. In the process a Gottfert Viscotester was used.

The spun fibre had the following properties:

| | |
|---|---|
| Titre | 1510 dtex |
| Tensile strength | 2.5 cN/tex |
| Elongation at break | 680% |
| Tension set after 50% elongation | 2% |
| Tension set after 100% elongation | 5% |
| Tension set after 200% elongation | 13% |
| Tension set after 300% elongation | 26% |

A similar fibre was drawn at 20° C. to 6×(500%) its original length. The properties of the fibre were measured again after allowing the fibre to relax for 24 hours (20±2° C., 65±5% relative humidity). The stretched fibre had the following properties:

| | |
|---|---|
| Titre | 845 dtex |
| Tensile strength | 4.3 cN/tex |
| Elongation at break | 380% |
| Tension set after 50% elongation | 0% |
| Tension set after 100% elongation | 0% |
| Tension set after 200% elongation | 3% |
| Tension set after 300% elongation | 7% |

EXAMPLE IV

The following materials were successively supplied to a Farrel 3500 cc kneader:

at t=0 1377 g EPDM rubber (Keltan® 714) and 1080 g copolyether ester (Arnitel® EM400); and at t=4 min. 243 g phenol resin (Schenectedy® SP1045).

On commencement of the experiment the temperature of the kneader was set at 180° C. and during the kneading it rose to 235° C. and was kept at that level during the kneading by regulating the speed of the kneader (90 to 160 RPM). After 8 minutes the mixture was discharged, granulated and dried for spinning experiments to be carried out. From the mixture a multifilament elastic fibre was produced by melt spinning. In this production process the Fourné Spintester was used. The melt spinning was carried out under the following conditions:

| | |
|---|---|
| melt temperature | 240° C. |
| throughput | 18 g/min |
| spinning block spinneret | 12 * 0.25 mm |
| L/D | 2 |
| winding speed | 120 m/min |

The spun fibre had the following properties:

| | |
|---|---|
| Titre | 1510 dtex (125 dtex per filament) |
| Tensile strength | 2.1 cN/tex |

-continued

| | |
|---|---|
| Elongation at break | 630% |
| Tension set after 50% elongation | 2% |
| Tension set after 100% elongation | 5% |
| Tension set after 200% elongation | 14% |
| Tension set after 300% elongation | 28% |

A similar fibre was drawn at 20° C. to 6×(400%) its original length. The properties of the fibre were measured again after allowing the fibre to relax for 24 hours (20±2° C., 65±5% relative humidity). The stretched fibre had the following properties:

| | |
|---|---|
| Titre | 912 dtex (76 dtex per filament) |
| Tensile strength | 3.2 cN/tex |
| Elongation at break | 380% |
| Tension set after 50% elongation | 0% |
| Tension set after 100% elongation | 1% |
| Tension set after 200% elongation | 5% |
| Tension set after 300% elongation | 9% |

EXAMPLE V

Using a ZSK 30/42D twin-screw extruder a dynamically vulcanized mixture (TPV) was prepared having the following composition:

| | |
|---|---|
| copolyether ester (Arnitel ® EM400) | 37.4% |
| rubber (EPDM, Keltan ® 714) | 50.0% |
| phenol resin (Schenectedy ® SP1045) | 6.5% |
| pigment (Kronos ® 2210) | 5.5% |
| stabilizer (Irganox ® 1098) | 0.6% |

The following conditions and settings were observed: throughput 4 kg/hour, residence time 3.5 min, extruder head melt temperature 280° C., speed 150 RPM. All components, except for the phenol resin, were metered at the beginning of the extruder. After the melting and mixing of the components, the phenol resin was metered through a side feeder in the form of a 50% (wt) solution in acetone. The resulting dynamically vulcanized mixture (TPV) was granulated and dried for spinning experiments to be carried out. The said phenol resin addition method was found to result in a TPV with a very homogeneous structure and which can be spun and wound up at very high speeds.

From the mixture a monofilament elastic fibre was produced by melt spinning. In this production process the FournéSpintester was used. The melt spinning took place under the following conditions:

| | |
|---|---|
| melt temperature | 239° C. |
| throughput of spinning pump | 18 g/min |
| spinning block spinneret | 1 * 0.50 mm |
| L/D | 2 |
| winding speed | 1100 m/min |

The spun fibre had the following properties:

| | |
|---|---|
| Titre | 109 dtex |
| Tensile strength | 2.3 cN/tex |
| Elongation at break | 510% |
| Tension set after 50% elongation | 1% |
| Tension set after 100% elongation | 5% |
| Tension set after 200% elongation | 14% |
| Tension set after 300% elongation | 28% |

A similar fibre was drawn at 20° C. to 5×(400%) its original length. The properties of the fibre were measured again after allowing the fibre to relax for 24 hours (20±2° C., 65±5% relative humidity). The stretched fibre had the following properties:

| | |
|---|---|
| Titre | 73 dtex |
| Tensile strength | 3.2 cN/tex |
| Elongation at break | 325% |
| Tension set after 50% elongation | 0% |
| Tension set after 100% elongation | 1% |
| Tension set after 200% elongation | 4% |
| Tension set after 300% elongation | 8% |

COMPARATIVE EXPERIMENT A

For the purpose of comparison a fibre was produced from just a copolyether ester (Arnitel® EM400). In this production process the Göttfert Viscotester was used. The spun fibre had the following properties:

| | |
|---|---|
| Titre | 813 dtex |
| Tensile strength | 3.7 cN/tex |
| Elongation at break | 575% |
| Tension set after 50% elongation | 8% |
| Tension set after 100% elongation | 18% |
| Tension set after 200% elongation | 40% |
| Tension set after 300% elongation | 75% |

A similar fibre was drawn at 20° C. to 5×(400%) its original length. The properties of the fibre were measured again after allowing the fibre to relax for 24 hours (20±2° C., 65±5% relative humidity). The stretched fibre had the following properties:

| | |
|---|---|
| Titre | 395 dtex |
| Tensile strength | 6.3 cN/tex |
| Elongation at break | 290% |
| Tension set after 50% elongation | 3% |
| Tension set after 100% elongation | 7% |
| Tension set after 200% elongation | 18% |
| Tension set after 300% elongation | break |

What is claimed is:

1. An elastic fiber measuring in at least one direction at most 250 μm, wherein the elastic fiber contains a mixture of a copolyester ether or a copolyester ester and a chemically crosslinked rubber, has a permanent elongation after 100% stretching of at most 9% and has an elongation at break of at least 450%.

2. An elastic fiber according to claim 1, wherein said elastic fiber includes thread, tape or film.

3. An elastic fiber according to claim 1, wherein said elastic fiber has a permanent elongation after 100% stretching of at most 6% and an elongation at break of at least 500%.

4. An elastic fiber according to claim 1, wherein said elastic fiber contains a mixture of a copolyether ester and a chemically crosslinked rubber.

5. An elastic fiber obtained from a mixture containing a copolyester ether or a copolyester ester and a chemically crosslinked rubber, said elastic fiber having a permanent elongation after 100% stretching of at most 3%.

6. An elastic fiber according to claim 5, wherein said elastic fiber has a permanent elongation after 100% stretching of at most 2%.

7. An elastic fiber according to claim 5, wherein the rubber is an EP(D)M rubber.

8. An elastic fiber according to claim 5, wherein the mixture is a thermoplastic vulcanizate.

9. An elastic fiber according to claim 8, wherein the mixture is a dynamically vulcanized thermoplastic vulcanizate.

10. An elastic fiber according to claim 1, wherein said elastic fiber measures in at least one direction at most 100 μm.

11. An elastic fiber according to claim 1, wherein said elastic fiber measures in at least one direction at most 50 μm.

12. An elastic fiber according to claim 5, wherein said fiber includes thread, tape or film.

13. An elastic fiber obtained by melt spinning a mixture of a copolyester ester or a copolyester ether and a rubber to form a fiber measuring in at least one direction at most 250 μm, wherein the rubber is completed or almost completely crosslinked at the moment said fiber is formed.

14. An elastic fiber according to claim 13, wherein said elastic fiber is a fiber having a titre of 25 dtex to 250 dtex.

15. An elastic fiber according to claim 13, wherein said elastic fiber is a thread or tape having a titre of 500 to 1000 dtex.

16. An elastic fiber according to claim 13, wherein said elastic fiber has a tension set of at most 3% after stretching 100%.

17. An elastic fiber according to claim 13, wherein said fiber includes thread, tape or film.

* * * * *